United States Patent [19]

Fukumoto

[11] Patent Number: 4,870,237

[45] Date of Patent: Sep. 26, 1989

[54] MICROWAVE OVEN WITH A RACK AND A TURNTABLE

[75] Inventor: Shigeaki Fukumoto, Nara, Japan

[73] Assignee: Sharp Kabushiki Kaisha, Osaka, Japan

[21] Appl. No.: 301,228

[22] Filed: Jan. 24, 1989

Related U.S. Application Data

[60] Division of Ser. No. 168,615, Mar. 8, 1988, Pat. No. 4,818,832, which is a continuation of Ser. No. 076,994, Jul. 20, 1987, abandoned, which is a continuation of Ser. No. 818,009, Jan. 3, 1986, abandoned.

[30] Foreign Application Priority Data

Feb. 14, 1985 [JP] Japan ..... 60-20302

[51] Int. Cl.[4] ..... H05B 6/78

[52] U.S. Cl. ..... 219/10.55 E; 219/10.55 F; 126/337 R; 126/338; 99/DIG. 14; 312/236

[58] Field of Search ..... 219/10.55 F, 10.55 E, 219/10.55 R, 392; 126/337 R, 337 A, 338, 339, 332–335; 99/448, 449, 450, 451, DIG. 14; 312/236

[56] References Cited

U.S. PATENT DOCUMENTS

| | | | |
|---|---|---|---|
| 273,004 | 2/1883 | Anderson | 126/137 R |
| 3,658,047 | 4/1972 | Happel | 126/137 R |
| 3,949,184 | 4/1976 | Freedman | 219/10.55 E |
| 4,434,344 | 2/1984 | Dills | 219/10.55 E |
| 4,508,947 | 4/1985 | Eke | 219/10.55 F |
| 4,510,362 | 4/1985 | Miller | 219/10.55 E |

*Primary Examiner*—Philip H. Leung

*Attorney, Agent, or Firm*—Flehr, Hohbach, Test, Albritton & Herbert

[57] ABSTRACT

A microwave oven of a type equipped with a turntable inside its heating chamber has indented parts formed on the walls of the heating chamber. A rack is supported over the turntable by supporting members which are attached to these indented parts. Each supporting member has a part which is rotatable around a horizontal axis such that it can be unfolded to protrude into the chamber or folded inside the indented part without protruding into the chamber.

5 Claims, 1 Drawing Sheet

MICROWAVE OVEN WITH A RACK AND A TURNTABLE

This application is a division of application Ser. No. 168,615 filed Mar. 8, 1988, now U.S. Pat. No. 4,818,832, which is a continuation of application Ser. No. 76,994 filed July 20, 1987, now abandoned, which is a continuation of Ser. No. 818,009 filed Jan. 13, 1986, now abandoned.

This invention relates to a microwave oven of a type equipped with a turntable in its heating chamber and more particularly to a rack for such a microwave oven of which the height can be adjusted.

When there are many items to be heated and/or cooked at the same time, one of the conventional methods used with a microwave oven of a type equipped with a turntable was, as shown in FIG. 4, to place a table-shaped rack 1 on top of the turntable 2 so that the items placed on the rack 1 can be heated at the same time as the rack 1 turns around with the turntable 2. One of the disadvantages of this method, however, is that the turntable 2 must carry the entire weight of the additional items to be heated as well as the weight of the rack 1 itself, and this has the undesirable effect of increased load on the driving mechanisms for the turntable as well as its motor. Another disadvantage is, as can be visualized easily from FIG. 4, that an object such as a plate which is larger than the diameter of the turntable cannot be accommodated because of the legs for the rack 1.

It is therefore an object of the present invention in view of the disadvantages described above to provide multi-level rack holders for a microwave oven of a type with a turntable such that the driving mechanism and the motor for the turntable will not be overburdened and further that an object like a square or rectangular tray larger than the diameter of the turntable can also be accommodated.

The above and other objects of the present invention are achieved by providing rack-holding pieces at the corners of the heating chamber where space is usually wasted. A metallic, plastic or glass rack is supported by these pieces such that the interior of the heating chamber is vertically partitioned.

The accompanying drawings, which are incorporated in and form a part of the specification, illustrate embodiments of the present invention and, together with the description, serve to explain the principles of the invention.

Figure 1:
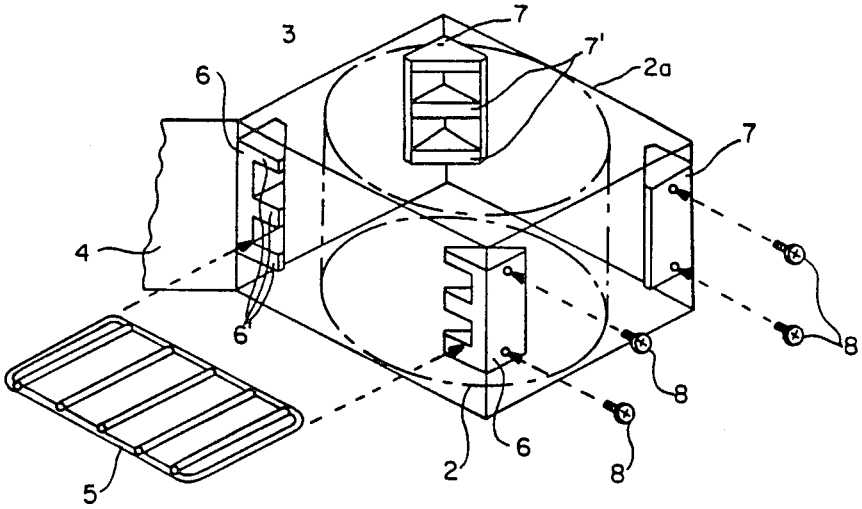
FIG. 1 is a schematic diagram showing rack-holding pieces embodying the present invention for the heating chamber of a microwave oven seen in a diagonal direction.

Reference being made to FIG. 1, numeral 3 indicates a wall plate of a heating chamber of a microwave oven and numeral 2 indicates a turntable inside the heating chamber. The circular column delineated by broken lines **2*a* and the turntable 2 indicates the effectively usable space when items to be heated are placed on the turntable 2. Numeral 4 indicates a door which opens the front side of the heating chamber. Numerals 6 and 7 indicate rack-holding pieces of the present invention, each being of an overall shape of a triangular column having a plurality of protruding sections 6' and 7'. They are attached by screws 8 to the side walls 3 of the heating chamber at selected corner positions. Numeral 5 indicates a metallic, plastic or glass rack and the protruding sections 6' and 7' of the rack-holding pieces 6 and 7 serve to support the rack 5** slidingly placed thereon.

Figure 2:
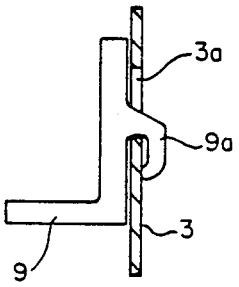
FIGS. 2 and 3 are cross-sectional views of rack-holding pieces according to other embodiments of the present invention.

Alternatively, the rack-holding pieces 6 and 7 may be attached to the side walls 3 by means of hook-like devices so that they may be removed easily. FIG. 2 shows a rack-holding piece 9 according to another embodiment of the present invention. The piece 9 is approximately L-shaped and provided with hook-like protrusions **9*a* on its vertical section. The piece 9 is removably secured to a side wall 3 by placing the protrusions 9*a* engagingly in grooves 3*a*** prepared at desired positions thereon.

Figure 3:
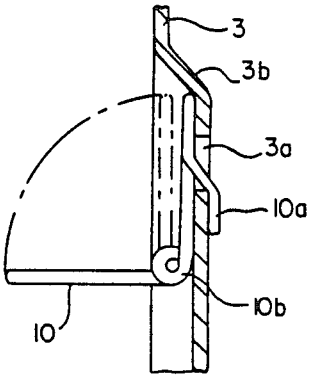
Figure 4:
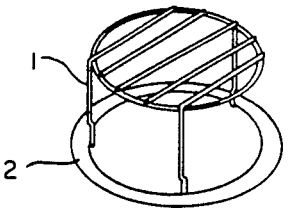
PRIOR ART FIG.-4
FIG. 4 is a perspective view of a rack of a conventional type placed on a turntable.

FIG. 3 shows a foldable rack-holding piece 10 according to still another embodiment of the present invention. The rack-holding piece 10 is connected rotatably by 90° around a horizontal axis **10*b* to a vertical section having hook-like protrusions 10*a*. The corresponding side wall 3 of the heating chamber is provided with grooves 3*a* for admitting the protrusions 10*a* so as to secure the piece 10 with respect to the wall 3. The wall 3 is indented, having an arched section 3*b* so that the rack-holding piece 10 can be completely folded into the hiding space created by the indented part of the wall 3 as shown by broken lines in FIG. 3**.

In summary, the present invention teaches the improvement to be made to a microwave oven of the type having a turntable in its heating chamber by making use of the space near the corners which is generally wasted in conventional microwave ovens. With multi-level rack-holding pieces installed in such wasted sections inside the heating chamber, more items can be heated at the same time on a rack by taking full advantage of the otherwise wasted space without increasing the load on the turntable-operating mechanisms or preventing the use of utensils such as a tray which may be larger than the diameter of the turntable.

Figure 5A:
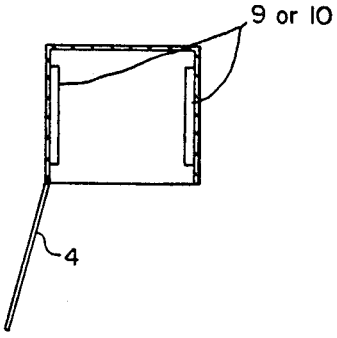
FIGS. 5A, 5B and 5C are simplified top views of the interior of a heating chamber for showing possible positions for installing the holding pieces of FIGS. 2 and 3.
Figure 5B:
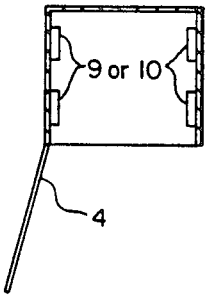
Figure 5C:
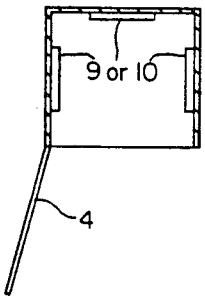

The foregoing description of preferred embodiments of the invention has been presented for purposes of illustration and description. It is not intended to be exhaustive or to limit the invention to the precise form disclosed, and obviously many modifications and variations are possible in light of the above teaching. For example, more than one rack-holding piece shown in FIGS. 2 and 3 may be provided vertically distributed so that the height of the rack 5 above the top surface of the turntable can be varied. Furthermore, neither the total number of rack-holding pieces 9 or 10 nor the choice of heating chamber walls on which they are made installable is intended to limit the scope of this invention. The rack-holding pieces 9 or 10, whether singly or in twos or more vertically separated as explained above, may be installed only on the two side walls, one unit on each wall as shown in FIG. 5A or two units on each wall as shown in FIG. 5B. Alternatively, three units may be installed as shown in FIG. 5C, one each on the two side walls and the back wall, or at least two units, one each on two of these three walls. FIGS. 5A, 5B and 5C are each a simplified top view of the heating chamber solely for the purpose of showing the possible positions of the rack-holding pieces 9 or 10 and numeral 4, indicating its door, serves to show the direction of the chamber.

What is claimed is:

1. A microwave oven heating chamber comprising walls having indented parts thereon, a turntable surrounded by said walls, a rack for placing thereon articles to be heated, and a plurality of rack-supporting members supporting said rack over said turntable and being attached to said indented parts of said walls, each of said supporting members having a rack-supporting part which is rotatable around a horizontal axis and assumes an unfolded position, protruding into said chamber to support said rack, or a folded position in said indented part without protruding into said chamber.

2. The microwave oven heating chamber of claim 1 wherein said walls include two side walls, one of said rack-supporting members being on each of said side walls.

3. The microwave oven heating chamber of claim 1 wherein said walls include two side walls, two of said rack-supporting members being on each of said side walls.

4. The microwave oven heating chamber of claim 1 wherein said walls include two side walls and one back wall, one of said rack-supporting members being on each of said side walls and said back wall.

5. The microwave oven heating chamber of claim 1 wherein said rack-supporting members are attached to said walls removably.

* * * * *